US012109609B2

(12) United States Patent
Shaber

(10) Patent No.: US 12,109,609 B2
(45) Date of Patent: Oct. 8, 2024

(54) MOLD CASTING SURFACE COOLING

(71) Applicant: WAGSTAFF, INC., Spokane Valley, WA (US)

(72) Inventor: Craig Shaber, Liberty Lake, WA (US)

(73) Assignee: WAGSTAFF, INC., Spokane Valley, WA (US)

( * ) Notice: Subject to any disclaimer, the term of this patent is extended or adjusted under 35 U.S.C. 154(b) by 0 days.

(21) Appl. No.: 18/517,780

(22) Filed: Nov. 22, 2023

(65) Prior Publication Data

US 2024/0091848 A1 Mar. 21, 2024

Related U.S. Application Data

(63) Continuation-in-part of application No. PCT/US2023/062022, filed on Feb. 6, 2023, which is a continuation of application No. 17/651,708, filed on Feb. 18, 2022, now Pat. No. 11,717,882.

(51) Int. Cl.
*B22D 11/055* (2006.01)

(52) U.S. Cl.
CPC ..... *B22D 11/055* (2013.01)

(58) Field of Classification Search
CPC ..... B22D 11/055; B22D 11/07; B22D 11/057; B22D 11/059; B22D 11/049
See application file for complete search history.

(56) References Cited

U.S. PATENT DOCUMENTS 2,871,534 A 2/1959 Weiland
3,292,216 A 12/1966 Colombo
3,537,507 A 11/1970 Rossi et al.
3,911,996 A 10/1975 Veillette
4,030,536 A 6/1977 Rodenchuk et al.
(Continued)

FOREIGN PATENT DOCUMENTS

CN 1857828 A 11/2006
CN 01925938 A 3/2007
(Continued)

OTHER PUBLICATIONS

International Search Report and Written Opinion for International Application No. PCT/IB2018/054214 dated Aug. 13, 2018.
(Continued)

*Primary Examiner* — Kevin P Kerns
*Assistant Examiner* — Steven S Ha
(74) *Attorney, Agent, or Firm* — Alston & Bird LLP

(57) ABSTRACT

The present invention relates to a method, system, and apparatus for improving the efficiency of a continuous casting operation. A continuous casting mold component described herein includes: a mold wall substrate defining a groove proximate a bottom of the mold wall substrate; a graphite liner having a bottom edge defining a first angled surface and a top edge defining a second angled surface, where the bottom edge is received into the groove of the mold wall substrate; and a clamping element defining an angled clamping surface attached to the mold wall substrate with at least one fastener, where the bottom angled surface of the graphite liner is driven into the groove defined in the substrate in response to the angled clamping surface of the clamping element engaging the second angled surface of the graphite liner and the fastener pressing the clamping element toward the mold wall substrate.

20 Claims, 13 Drawing Sheets

(56) References Cited

U.S. PATENT DOCUMENTS

| | | | |
|---|---|---|---|
| 4,245,692 | A | 1/1981 | Hargassner et al. |
| 4,270,593 | A | 6/1981 | Bachner |
| 4,505,321 | A | 3/1985 | Zeller |
| 4,523,623 | A | 6/1985 | Holleis et al. |
| 4,580,614 | A | 4/1986 | Haissig |
| 4,635,704 | A | 1/1987 | Chielens et al. |
| 4,669,526 | A | 6/1987 | Hury |
| 4,727,926 | A | 3/1988 | Tsutsumi et al. |
| 4,947,925 | A | 8/1990 | Wagstaff et al. |
| 5,279,354 | A | 1/1994 | Grove |
| 5,318,098 | A | 6/1994 | Wagstaff et al. |
| 5,518,063 | A | 5/1996 | Wagstaff et al. |
| 5,947,184 | A | 9/1999 | Steen et al. |
| 6,192,970 | B1 | 2/2001 | Tilak |
| 8,561,669 | B2 | 10/2013 | Nasee, Jr. et al. |
| 9,630,244 | B2 | 4/2017 | Jarry et al. |
| 10,350,674 | B2 | 6/2019 | Cordill et al. |
| 11,331,715 | B2 | 5/2022 | Cordill et al. |
| 11,883,876 | B2 | 1/2024 | Cordill et al. |
| 2003/0160360 | A1 | 8/2003 | Naito |
| 2004/0055732 | A1 | 3/2004 | LeBlanc et al. |
| 2009/0000760 | A1 | 1/2009 | Kang et al. |
| 2012/0241118 | A1 | 9/2012 | Wagstaff |
| 2020/0101527 | A1 | 4/2020 | Cordill et al. |

FOREIGN PATENT DOCUMENTS

| | | | |
|---|---|---|---|
| CN | 101835551 | | 9/2010 |
| CN | 102223967 | | 10/2011 |
| DE | 2923113 | | 12/1979 |
| DE | 434312 | | 6/1995 |
| EP | 0492176 | A1 | 7/1992 |
| FR | 2825038 | | 11/2002 |
| JP | S5026724 | | 3/1975 |
| JP | S 54 -013422 | A | 1/1979 |
| JP | S 57-115946 | A | 7/1982 |
| JP | H 10500629 | | 1/1998 |
| JP | H 10-193043 | A | 7/1998 |
| JP | 2000-000639 | A | 1/2000 |
| JP | 3400355 | | 4/2003 |
| JP | 2016-022521 | A | 2/2016 |
| SU | 150727 | A2 | 9/1989 |

OTHER PUBLICATIONS

Office Action for Russian Application No. 2019144046/05 dated May 13, 2020.

Office Action for Australian Application No. 2018283785 dated Aug. 31, 2020.

Office Action for Japanese Application No. 2019-569311 dated Nov. 24, 2020.

2nd Office Action for China Application No. 201880039319.1 dated Sep. 16, 2021 (12 pages).

Office Action for Brazil Application No. BR112019026131-1 mailed Jul. 4, 2022 (4 pages).

Office Action for Venezuela Patent Application No. VE 2019-0252 received Jul. 27, 2022 (1 page).

Office Action for Bahrain Application No. 20190295 dated Feb. 27, 2023 w/English translation (12 pages).

International Search Report and Written Opinion for PCT/US2023/062022 (ISA/EP) mailed May 15, 2023 (17 pages).

MOLD CASTING SURFACE COOLING

CROSS-REFERENCE TO RELATED APPLICATIONS

This application is a Continuation-in-Part of and claims priority to Patent Cooperation Treaty Application No. PCT/US2023/062022, filed on Feb. 6, 2023, which claims priority to U.S. patent application Ser. No. 17/651,708, filed on Feb. 18, 2022, the contents of each of which are hereby incorporated by reference.

TECHNOLOGICAL FIELD

The present invention relates to a method, system, and apparatus for improving the efficiency of a continuous casting operation, and more particularly, to promoting effective cooling of a casting face of a wall of a continuous casting mold.

BACKGROUND

Metal products may be formed in a variety of ways; however numerous forming methods first require an ingot, billet, or other cast part that can serve as the raw material from which a metal end product can be manufactured, such as through rolling or machining, for example. One method of manufacturing an ingot or billet is through a semi-continuous casting process known as direct chill casting, whereby a vertically oriented mold cavity is situated above a platform that translates vertically down a casting pit. A starting block may be situated on the platform and form a bottom of the mold cavity, at least initially, to begin the casting process. Molten metal is poured into the mold cavity whereupon the molten metal cools, typically using a cooling fluid. The platform with the starting block thereon may descend into the casting pit at a predefined speed to allow the metal exiting the mold cavity and descending with the starting block to solidify. The platform continues to be lowered as more molten metal enters the mold cavity, and solid metal exits the mold cavity. This continuous casting process allows metal ingots and billets to be formed according to the profile of the mold cavity and having a length limited only by the casting pit depth and the hydraulically actuated platform moving therein. Maintaining a casting surface of mold walls below a temperature above which a casting surface lubricant would burn or evaporate is important to ensure the quality and consistency of the casting.

BRIEF SUMMARY

The present invention relates to method, system, and apparatus for improving the efficiency of a continuous casting operation, and more particularly, to promoting effective cooling of a casting face of a wall of a continuous casting mold. Embodiments described herein employ a graphite casting surface in the form of a graphite liner received at a mold wall substrate. The graphite liner is configured to positively engage the mold wall substrate to ensure maximum contact between a back surface of the graphite liner with the mold wall substrate to maximize heat transfer from the graphite liner through the mold wall substrate, and to a cooling fluid. Embodiments described herein include a graphite liner for a continuous casting mold including: a bottom edge defining a first angled surface and a top edge defining a second angled surface, where the bottom edge is received into a groove of the continuous casting mold, where the graphite liner is configured to be reversible, where the bottom edge becomes the top edge, and where a mold wall and a clamping element cooperate to clamp the graphite liner to the mold wall of the continuous casting mold, where the graphite liner defines a resting state and an installed state, where the graphite liner in the resting state comprises a curvature along a back face of the graphite liner between the top edge and the bottom edge, and where the back face is straightened in the installed state in response to the graphite liner being clamped to the mold wall of the continuous casting mold.

The graphite liner of an example embodiment has a first thickness proximate a center of a vertical height of the graphite liner, a second thickness proximate the top edge of the graphite liner, and a third thickness proximate the bottom edge of the graphite liner, where the first thickness is greater than the second thickness and the third thickness. According to some embodiments, the second thickness is substantially equal to the third thickness but can be either thicker or thinner. The curvature along the back face of the graphite liner is, in some embodiments, a convex curvature.

The curvature of the back face of the graphite liner of some embodiments includes a curvature profile, where in the installed state, a force is applied by the graphite liner to the mold wall of the continuous casting mold in response to a fastener pressing a clamping element toward the mold wall. The curvature profile of some embodiments is configured to concentrate the force applied by the graphite liner to the mold wall in the installed state at a lower third of a height of the graphite liner.

Embodiments provided herein include a continuous casting mold component including: a mold wall substrate defining a groove proximate a bottom of the mold wall substrate; a graphite liner having a bottom edge defining a first angled surface and a top edge defining a second angled surface, where the bottom edge is received into the groove of the mold wall substrate; and a clamping element defining an angled clamping surface attached to the mold wall substrate with at least one fastener, and where the graphite liner is configured to be reversible, where the bottom edge becomes the top edge, where the mold wall and the clamping element cooperate to clamp the graphite liner to the mold wall, where the graphite liner defines a resting state and an installed state, where the graphite liner is in the installed state when the clamping element and the mold wall cooperate to clamp the graphite liner to the mold wall, and where a back surface of the graphite liner defines a curve between the top edge and the bottom edge in the resting state, and wherein the graphite liner is straightened between the top edge and the bottom edge in the installed state.

The graphite liner of some embodiments has a first thickness proximate a center of a vertical height of the graphite liner, a second thickness proximate a top of the graphite liner, and a third thickness proximate a bottom of the graphite liner, where the first thickness is greater than the second thickness or the third thickness. The second thickness and the third thickness are, in some embodiments, substantially equal.

According to some embodiments, the first angled surface of the graphite liner is driven into the groove defined in the substrate in response to the angled clamping surface of the clamping element engaging the second angled surface of the graphite liner and the fastener pressing the clamping element toward the mold wall substrate. According to some embodiments, the graphite liner in the resting state defines a curvature along a back face of the graphite liner between the top edge and the bottom edge, and where the back face is straightened in the installed state in response to the fastener pressing the clamping element toward the mold wall substrate. According to some embodiments, the curvature of the back face of the graphite liner defines a curvature profile, where in the installed state, a force is applied by the graphite liner to the mold wall substrate in response to the fastener pressing the clamping element toward the mold wall.

The curvature profile of an example embodiment is configured to concentrate the force applied by the graphite liner to the mold wall substrate in the installed state at a lower third of the graphite liner. The mold wall substrate of an example embodiment further defines a substrate angled surface proximate a top of the mold wall substrate, where the clamping element defines an angled driving surface, where in response to the fastener pressing the clamping element toward the mold wall substrate, the substrate angled surface cooperates with the angled driving surface to drive the clamping element toward the bottom of the mold wall substrate. The fastener of an example embodiment is a threaded fastener, where the clamping element defines a slot to receive the threaded fastener, and where the threaded fastener is received into a threaded hole of the mold wall substrate.

According to some embodiments, the slot defined in the clamping element has a relatively narrow dimension in a direction of an axis along which the mold wall substrate extends, and a relatively long dimension extending in a direction toward the bottom of the mold wall substrate. The clamping element of an example embodiment is driven in a direction toward the bottom of the mold wall substrate in response to the threaded fastener being tightened into the threaded hole of the mold wall substrate. The graphite liner of an example embodiment includes a first thickness proximate a top edge of the graphite liner and a second thickness proximate the bottom edge, where the first thickness is greater than the second thickness. The graphite liner of an example embodiment tapers from the first thickness to the second thickness.

BRIEF DESCRIPTION OF THE DRAWINGS

Figure 1:
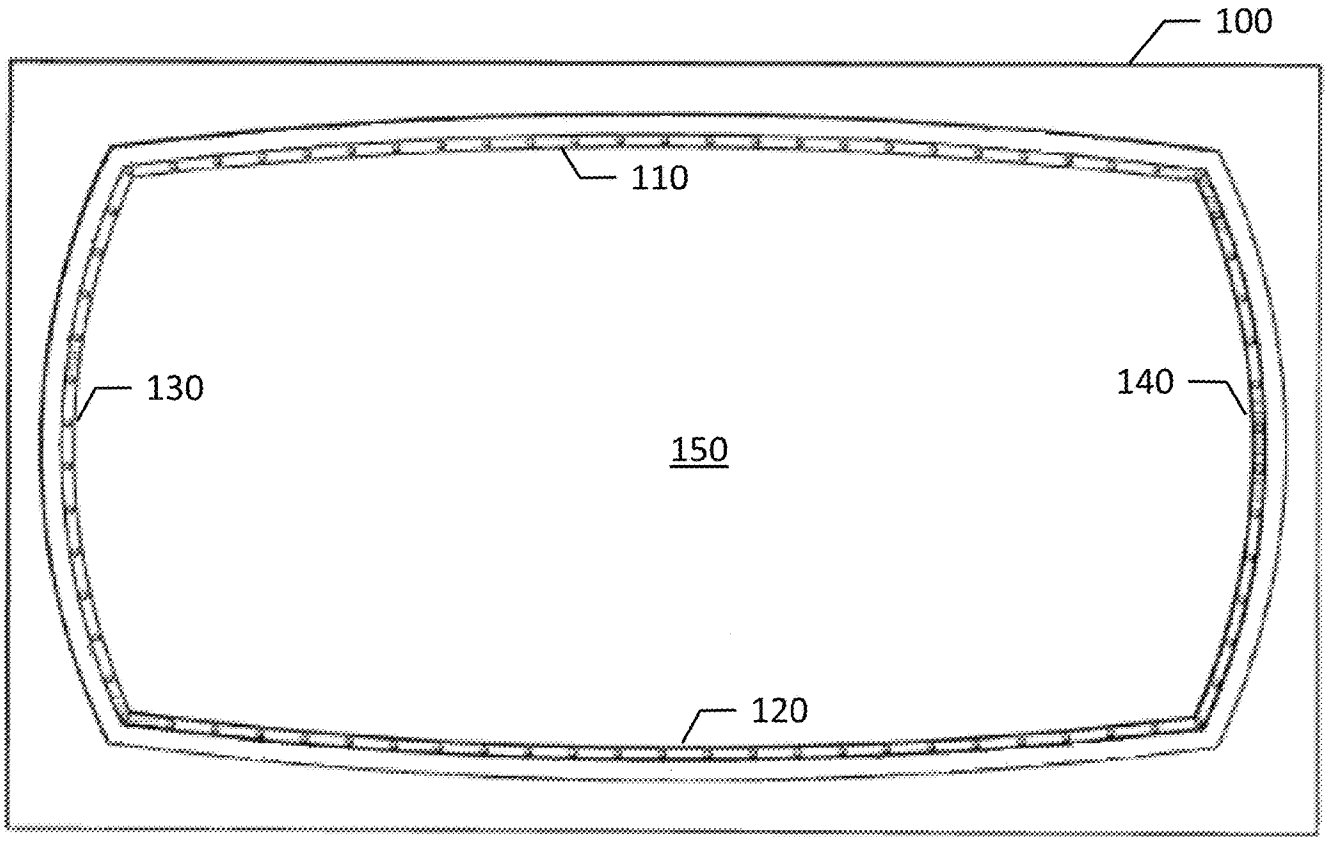
FIG. 1 (PRIOR ART)
Figure 2:
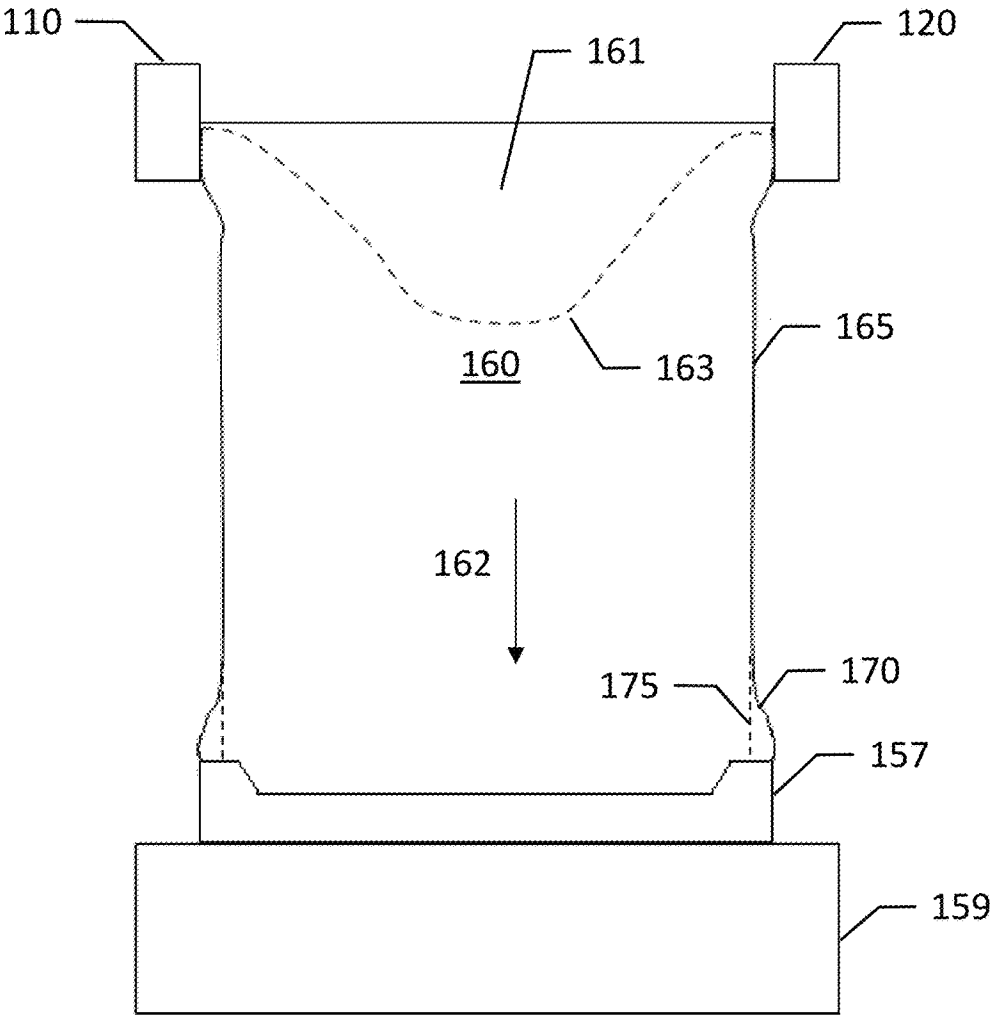
Figure 3:
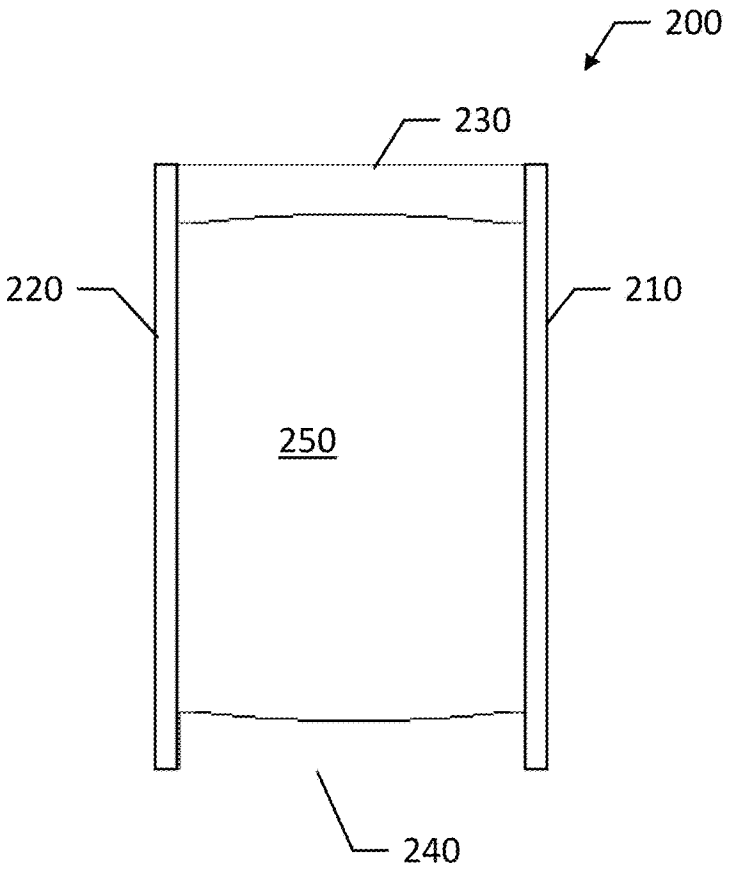
Figure 4:
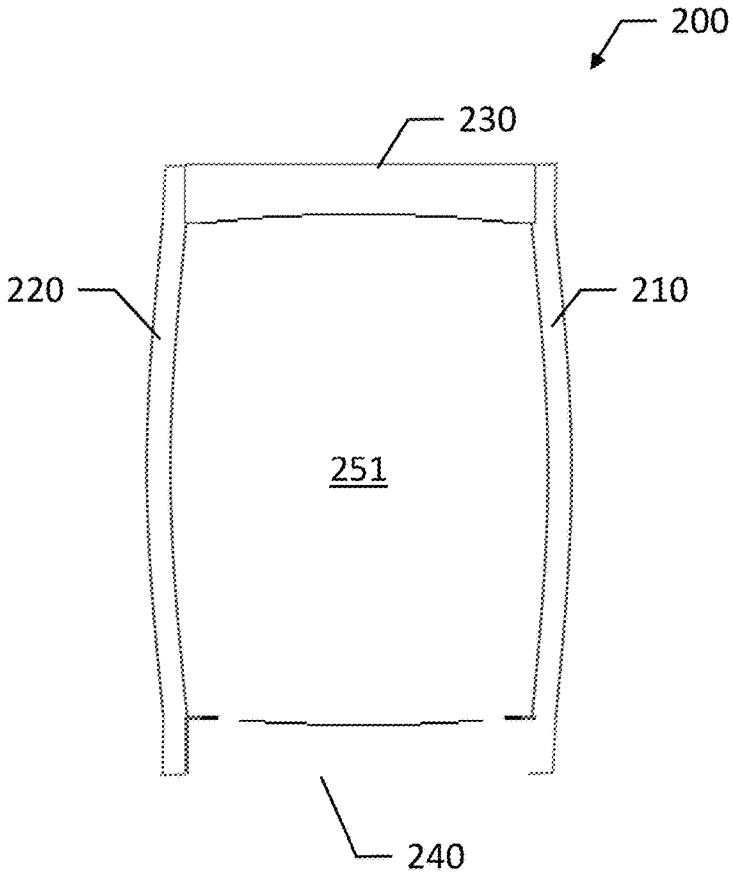
Figure 5:
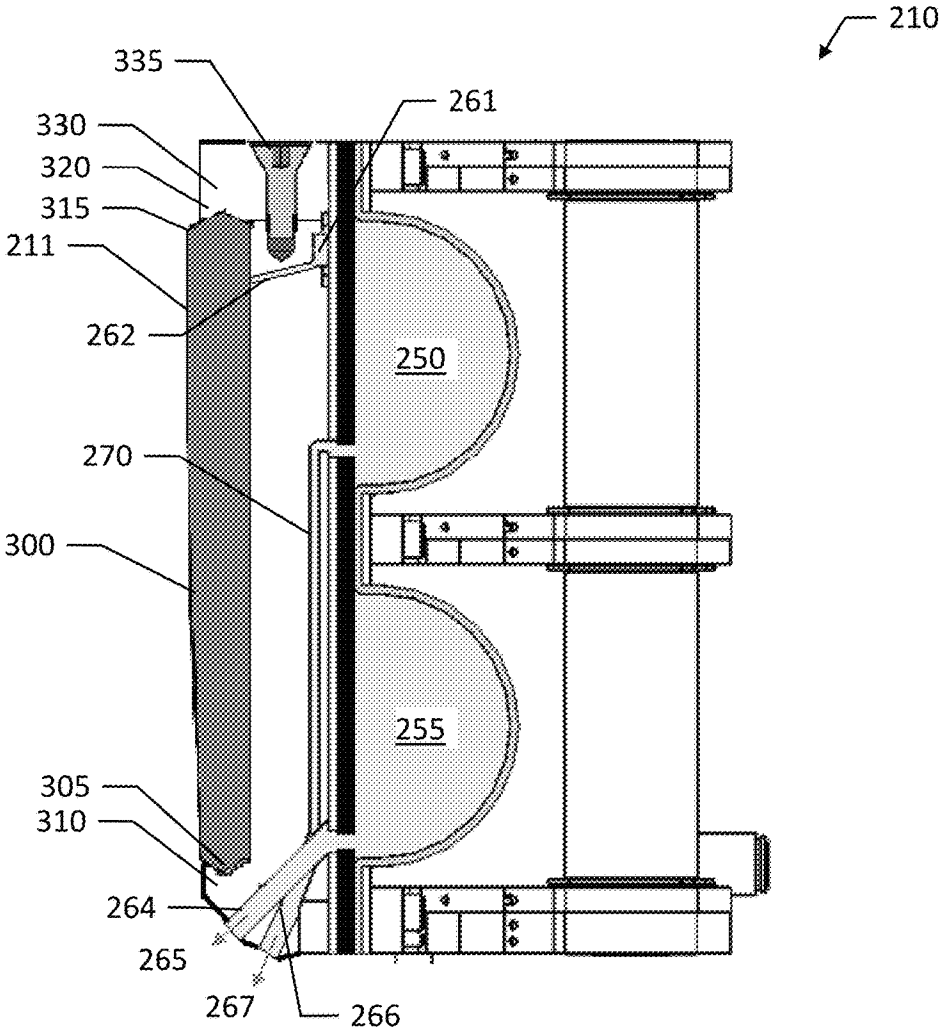
Figure 6:
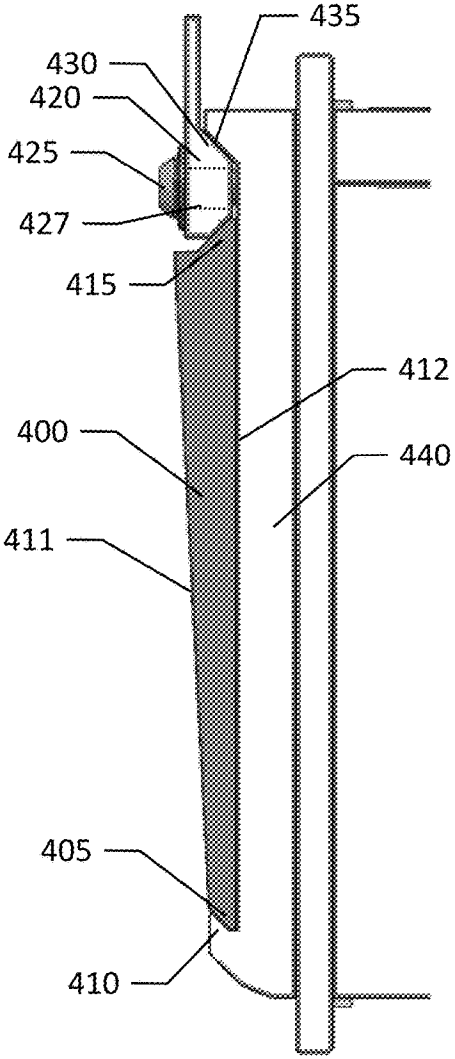
Figure 7:
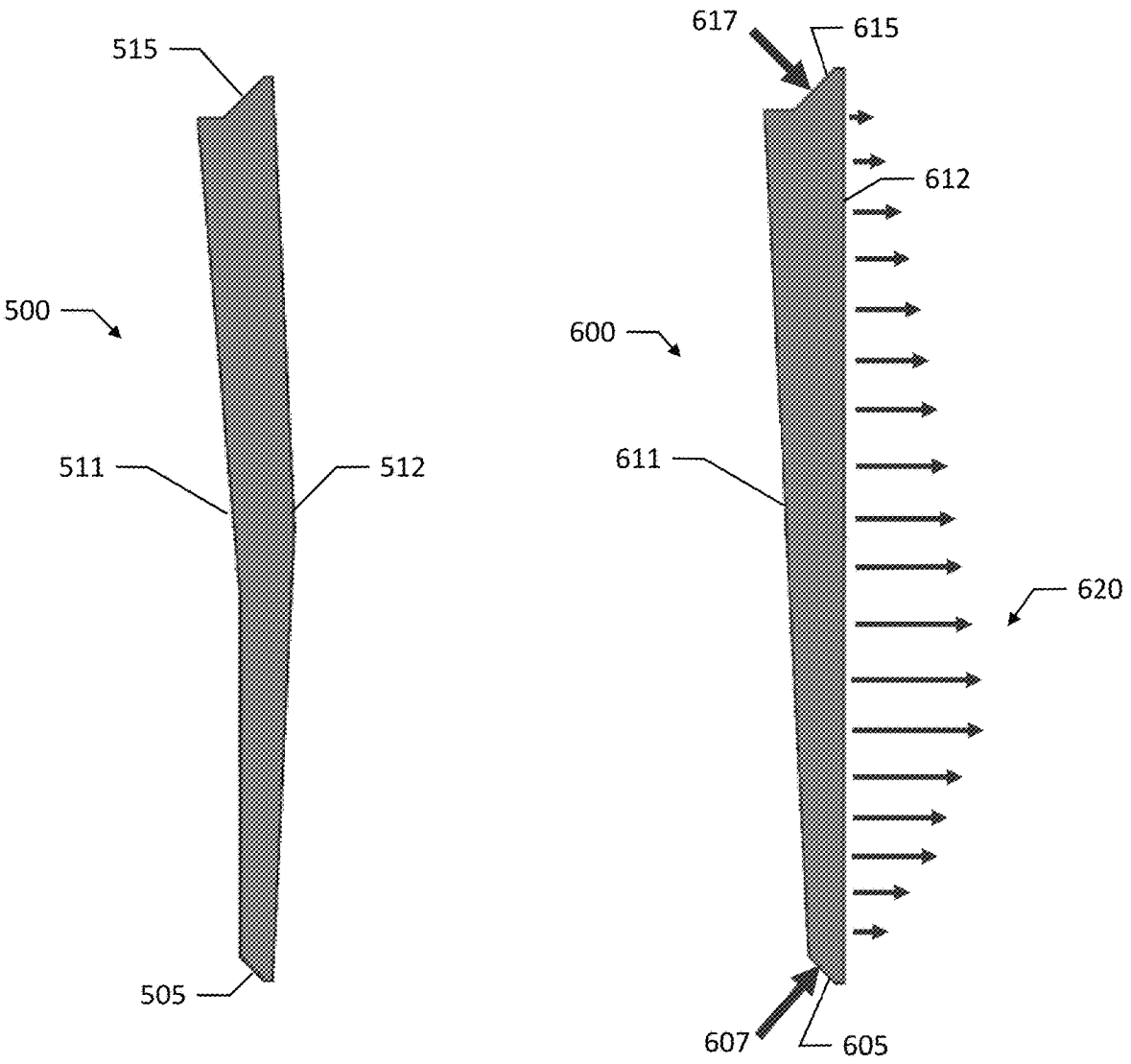
Figure 8:
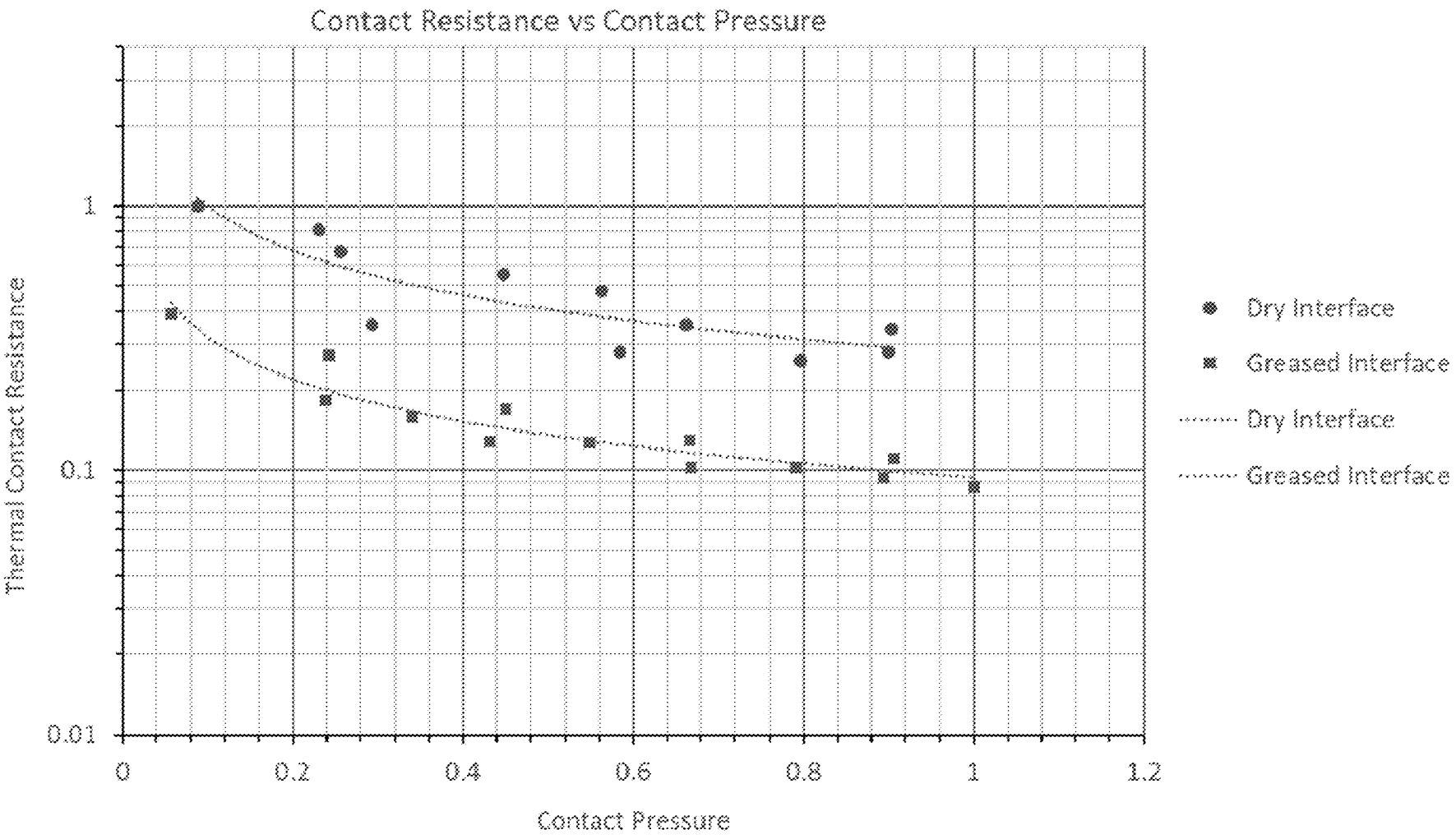
Figure 9:
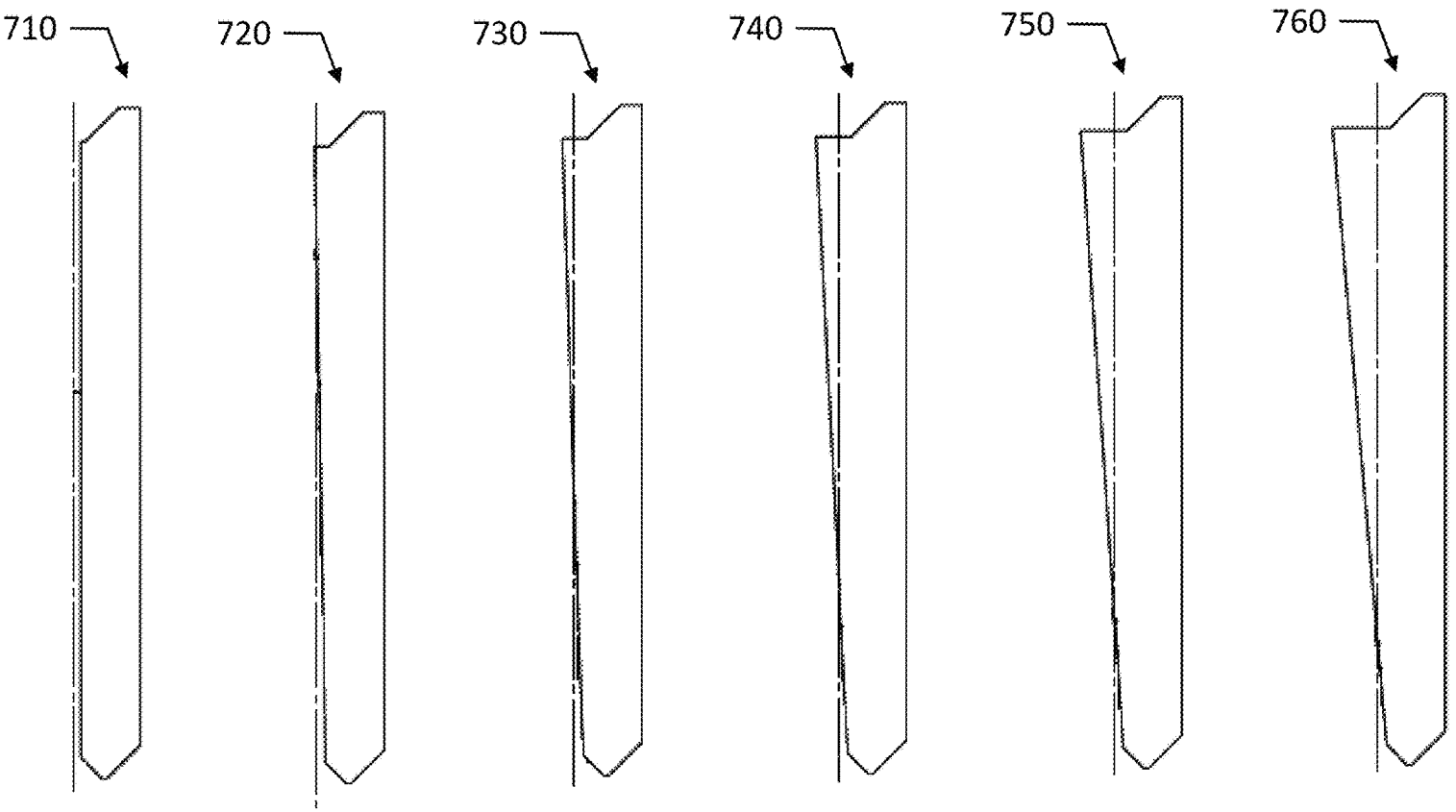
Figure 10:
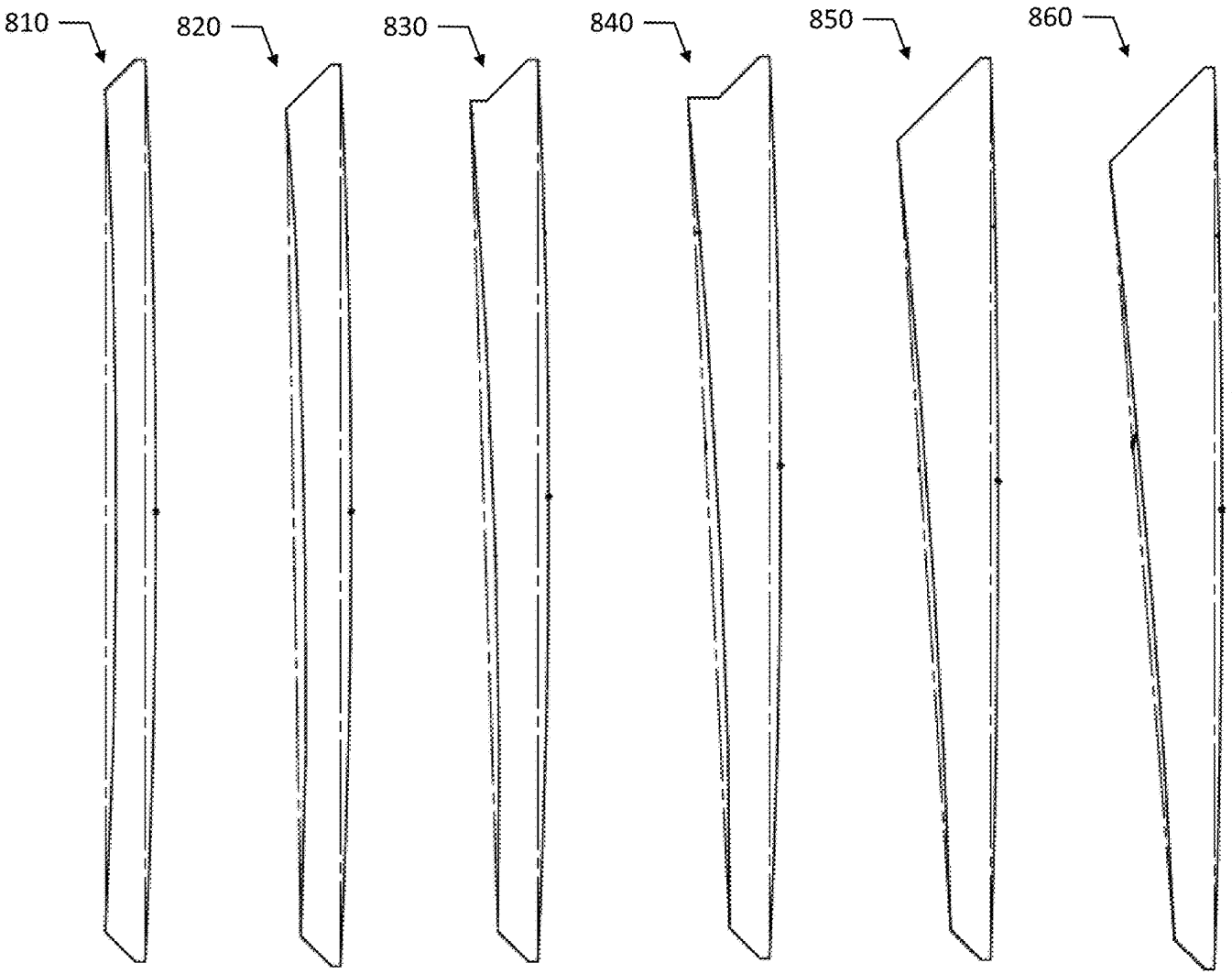
Figure 11:
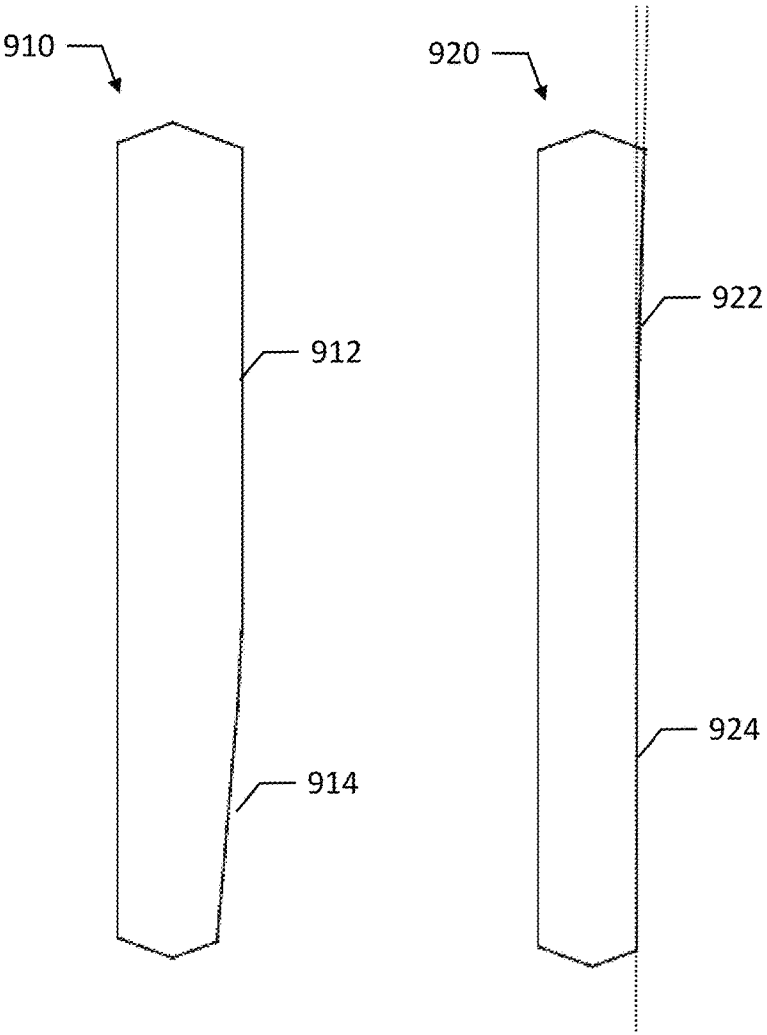
Figure 12:
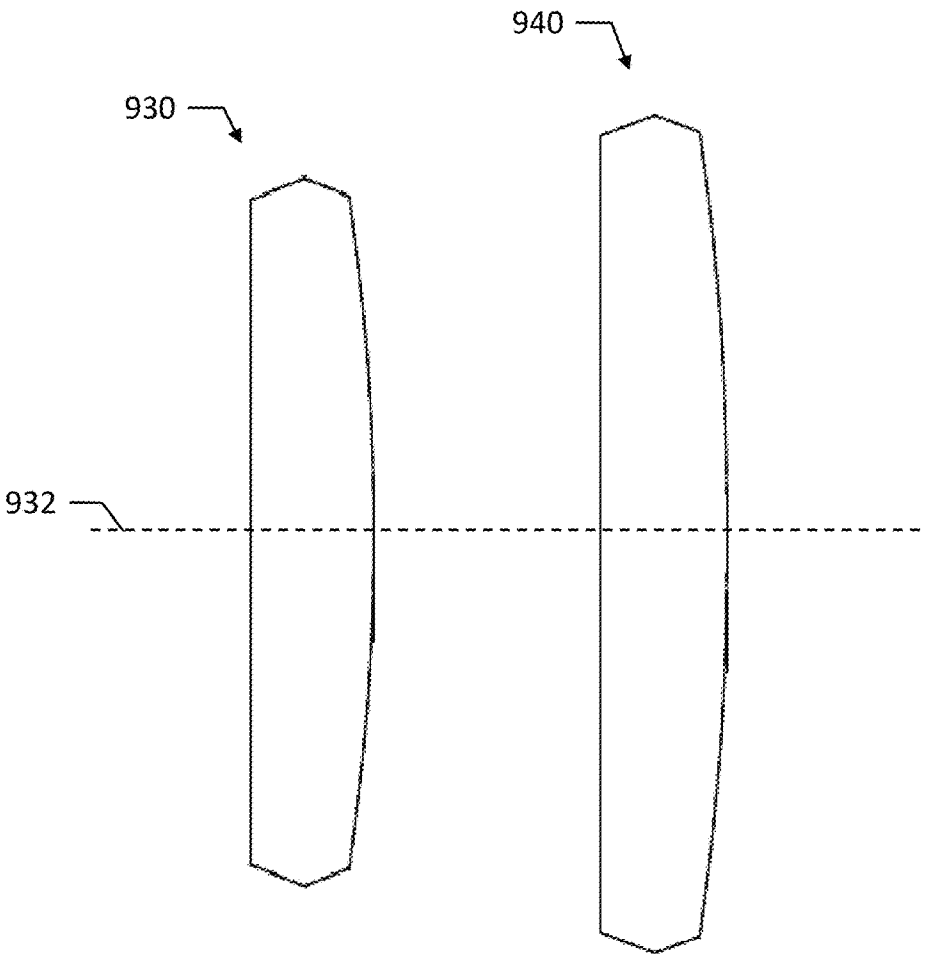
Figure 13:
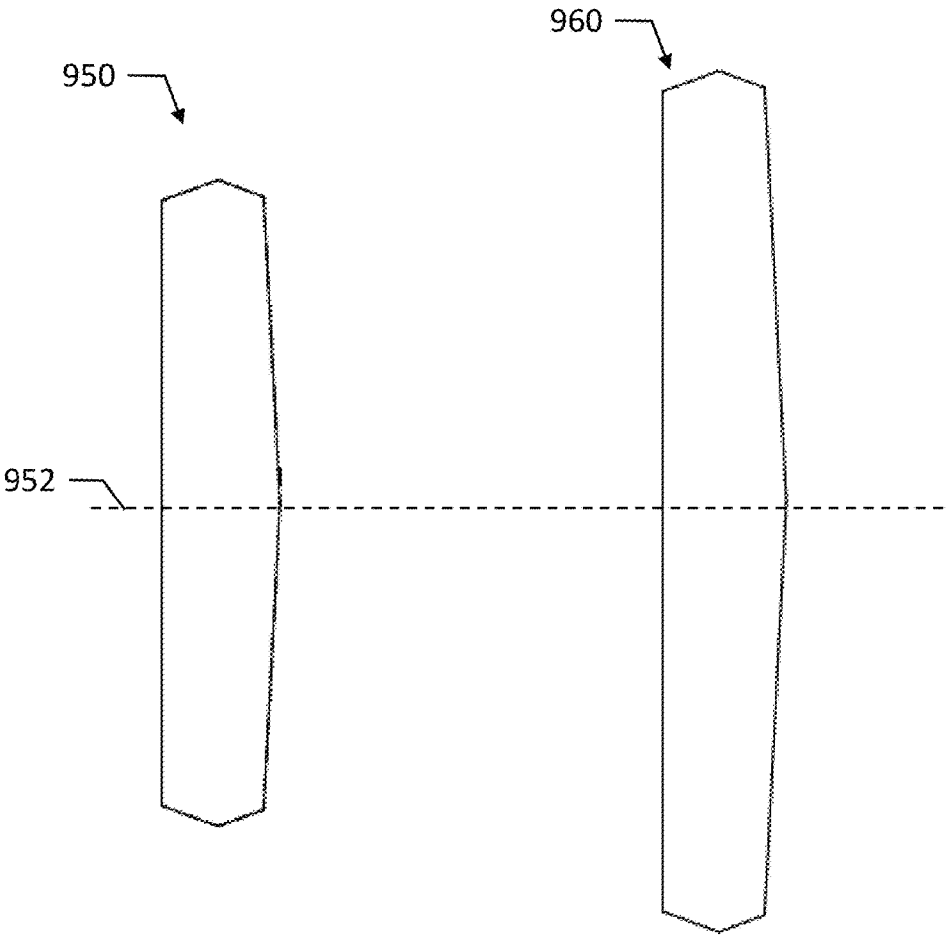

Having thus described the invention in general terms, reference will now be made to the accompanying drawings, which are not necessarily drawn to scale, and wherein:

FIG. 1 illustrates an example embodiment of a direct chill casting mold according to the prior art;

FIG. 2 illustrates an ingot formed through direct chill casting according to the prior art;

FIG. 3 illustrates a top view of a direct chill casting mold having sides capable of being flexed in an un-flexed configuration according to an example embodiment of the present disclosure;

FIG. 4 illustrates a top view of a direct chill casting mold having sides capable of being flexed in a flexed configuration according to an example embodiment of the present disclosure;

FIG. 5 illustrates a cross-section view of a mold side wall including a graphite liner having a casting face according to an example embodiment of the present disclosure;

FIG. 6 illustrates another cross-section view of a mold side wall including a graphite liner having a casting face and a clamping mechanism according to an example embodiment of the present disclosure;

FIG. 7 illustrates a graphite liner in both a resting state and an installed state, along with the forces exerted by the graphite liner in the installed state according to an example embodiment of the present disclosure;

FIG. 8 illustrates a plot depicting the relationship between thermal contact resistance and contact pressure, reflecting the thermal transfer characteristics according to an example embodiment of the present disclosure;

FIG. 9 illustrates several embodiments of profiles of graphite liners according to example embodiments of the present disclosure;

FIG. 10 illustrates further embodiments of profiles of graphite liners according to example embodiments of the present disclosure;

FIG. 11 illustrates further embodiments of profiles of graphite liners according to example embodiments of the present disclosure;

FIG. 12 illustrates further embodiments of profiles of graphite liners according to example embodiments of the present disclosure; and FIG. 13 illustrates further embodiments of profiles of graphite liners according to example embodiments of the present disclosure.

DETAILED DESCRIPTION

Exemplary embodiments of the present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

Embodiments of the present invention generally relate to an apparatus, system, and method for improving the efficiency of a continuous casting operation, and more particularly, to promoting effective cooling of a casting face of a wall of a continuous casting mold. For a continuous casting operation to function effectively and properly, the walls of a continuous casting mold must enable the cast material to pass through the mold as it begins to cool. The walls of a continuous casting mold can be lubricated to facilitate this. Further, graphite can be used as an inner surface of the walls of a continuous casting mold to promote a smooth flow of the cast through a low-friction surface. According to some embodiments, oil or grease is spread on the graphite inner surface of the walls of a continuous casting mold. The oil or grease is consumed during a casting operation as it migrates to the surface of the graphite facing the casting. It is important that the graphite remains cool and below a working temperature of the lubricant or the lubricant may burn and glaze the surface of the graphite, preventing oil from migrating into or out of the graphite.

A typical direct chill continuous casting mold or direct chill casting mold is water cooled. Water can be used to cool the mold walls through channels that run along the mold walls and conduct cooling water across the backs of the mold walls to draw heat from the mold walls. Conduction of the heat from the mold walls to the cooling water flowing through the channels along the mold walls can be used to help keep the mold side wall and the graphite at a suitable temperature where the lubricant does not risk burning. Embodiments provided herein aid in the conduction of heat from the graphite to the mold wall by pressing the graphite into the mold wall, typically made of aluminum. Greater interface pressure leads to better heat conduction.

Vertical direct chill casting or continuous casting is a process used to produce ingots that may have large cross sections for use in a variety of manufacturing applications.

The process of vertical direct chill casting begins with a horizontal table or mold frame containing one or more vertically-oriented mold cavities disposed therein. Each of the mold cavities is initially closed at the bottom with a starting block or starting plug to seal the bottom of the mold cavity. Molten metal is introduced to each mold cavity through a metal distribution system to fill the mold cavities. As the molten metal proximate the bottom of the mold, adjacent to the starting block solidifies, the starting block is moved vertically downward along a linear path. The movement of the starting block may be caused by a hydraulically-lowered platform to which the starting block is attached. The movement of the starting block vertically downward draws the solidified metal from the mold cavity while additional molten metal is introduced into the mold cavities. Once started, this process moves at a relatively steady-state for a semi-continuous casting process that forms a metal ingot having a profile defined by the mold cavity, and a height defined by the depth to which the platform and starting block are moved.

During the casting process, the mold itself is cooled to encourage solidification of the metal prior to the metal exiting the mold cavity as the starting block is advanced downwardly, and a cooling fluid is introduced to the surface of the metal proximate the exit of the mold cavity as the metal is cast to draw heat from the cast metal ingot and to solidify the molten metal within the now-solidified shell of the ingot. As the starting block is advanced downward, the cooling fluid may be sprayed directly on the ingot to cool the surface and to draw heat from within the core of the ingot.

The direct chill casting process enables ingots to be cast of a wide variety of sizes and lengths, along with varying profile shapes. While rectangular ingots are most common, other profile shapes are possible. Circular profile billets benefit from a uniform shape, where the distance from the external surface around the billet to the core is equivalent around the perimeter. However, rectangular ingots lack this uniformity of surface-to-core depth and thus have additional challenges to consider during the direct chill casting process.

A direct chill casting mold to produce an ingot with a rectangular profile does not have a perfectly rectangular mold cavity due to the deformation of the ingot as it cools after leaving the mold cavity. The portion of the ingot exiting the mold cavity as the platform and the starting block descend retains a molten or at least partially molten core inside the solidified shell. As the core cools and solidifies, the external profile of the ingot changes such that the mold cavity profile, while it defines the shape of the final, cooled ingot, does not have a shape or profile that is identical to the final, cooled ingot.

FIG. 1 is an example embodiment of a conventional direct chill casting mold 100 which would be received within a table or frame assembly of a direct chill casting system. As shown, the mold 100 includes first 110 and second 120 opposing side walls extending between first 130 and second 140 end walls of the mold cavity. The first and second opposing side walls 110, 120 and the first and second end walls 130, 140, combine to form the mold cavity 150 having a generally rectangular profile. The first and second opposing side walls 110, 120, have an arcuate shape, or at least some degree of curvature to the wall profile. This shape enables the cast ingot to have substantially flat opposing sides during a steady-state casting operation of the direct chill casting process. The end walls 130 and 140 may also have a specified shape, which may include a curvature, a series of flat sides arranged in an arcuate shape, a compound curvature, or a straight side, for example. The "steady-state" portion of the casting process, as described herein, is the portion of the casting process after the initial start-up phase or start up casting phase and before the end of the casting process or ending casting phase. Steady-state casting occurs when the temperature profile in the portion of the ingot exiting the mold cavity remains constant or near constant. Different casting control parameters may be desired at each phase of the casting from starting phase to steady-state phase to ending phase based on the type of material being cast. While the example embodiment of FIG. 1 depicts an ingot mold shape (e.g., substantially rectangular), embodiments described herein can be employed with billet mold shapes (e.g., substantially circular).

While direct chill casting molds have been designed and developed to generate an ingot having substantially flat sides on its rectangular profile for the ingot portion produced during a steady-state portion of the casting process, the start-up process of direct chill casting includes challenges that distinguish the start-up casting phase process and the initial portion of the ingot formed during the start-up casting phase process from the steady-state phase of the casting process and the portion of the ingot formed during steady-state casting.

During the start-up phase of direct chill casting, high thermal gradients induce thermal stresses that cause deformation of the ingot in manners that are distinct from those experienced during the steady-state phase of casting. Due to the changes in thermal gradients and stresses experienced in the start-up phase versus the steady-state phase of casting, a constant-profile mold cavity results in a non-uniform profile of the ingot portion cast during the start-up phase, also known as the butt, and the ingot cast during the steady-state casting phase. As the portion produced during steady-state casting forms the majority of the ingot, the mold profile may be designed such that the opposed sides and ends of an ingot are substantially flat. This may result in a butt of the ingot formed during the start-up phase lacking substantially flat sides, as illustrated in the cast ingot cross-section of FIG. 2. The illustrated embodiment of FIG. 2 depicts a basic cross-section of an ingot mold during the casting process. As illustrated, the molten metal 161 is received within the cavity of the mold, between mold side walls 110 and 120, where the molten metal transitions to solid metal proximate the sump indicated by dashed line 163. The starting block 157 of the illustrated position has already descended with the platform 159 in the direction of arrow 162, and the casting is presently in the steady-state phase, with the sides 165 of the ingot 160 being substantially flat. The portion of the ingot 160 produced during the start-up phase is shown adjacent to the starting block 157 with a profile that is a swollen profile 170 with respect to the desirable flat sides 175 of the steady-state casting phase.

The deformation of the ingot portion with the swollen profile produced during the start-up phase may not be usable depending upon the end-use of the ingot, such that the portion of the ingot formed during the start-up period may be sacrificial (i.e., cut from the ingot and repurposed/re-cast). This sacrificial butt portion of the ingot may be substantial in size, particularly in direct chill casting molds that have relatively large profiles, and while the butt may be re-cast so the material is not lost, the lost time, reheating/re-melting costs and labor associated with the lost portion of the ingot, and the reduced maximum size potential of an ingot result in losses in efficiency of the direct chill casting process. Similar issues may exist at the end of a casting in forming the "head" of the ingot or billet, where casting ceases to be steady-state and may require specific control parameters to maximize the useable portion of the ingot and reduce waste.

To solve or improve upon the issues described above, a direct chill casting mold can employ flexible opposing side walls that may be dynamically moved during the casting process to eliminate the butt swell of conventional direct chill ingot casting molds to reduce waste and to improve the efficiency with which ingots are cast. Direct chill casting molds as described herein may include an opposed pair of casting surfaces on side walls of the mold that are flexible allowing them to change shape while the mold is casting an ingot. Each of the opposed side walls may include two or more contact portions or force receiving elements, each configured to receive a force that causes the opposed side walls of the mold to move dynamically and change shape during the casting process. The forces applied to the two or more contact regions may be independent and may include forces in opposing directions, as described further below. The contact regions may optionally be repositionable along the length of the opposing side walls to enable greater control over the shape of the side wall resulting from the forces applied.

FIG. 3 illustrates a top-view of a direct chill casting mold assembly 200 configured to have a variable profile to improve the quality and consistency of a casting. As shown, the mold assembly 200 includes first and second opposing side wall assemblies 210, 220, and first and second end wall assemblies 230, 240. Each of the opposing side wall assemblies 210, 220 includes a side wall of the mold cavity 251 that cooperates with end walls of end wall assemblies 230 and 240 to form the profile of the mold cavity which is the shape of the perimeter of the mold cavity. FIG. 4 illustrates a top-view of the direct chill casting mold assembly 200 of FIG. 3 with a curvature imparted to the side wall assemblies 210, 220.

Various mechanisms can be employed to impart the curvature to the side wall assemblies of the direct chill casting mold. However, in practice, direct chill casting molds are often arranged in a set of direct chill casting molds positioned adjacent to one another above a casting pit. The size of the casting pit and the frame above the casting pit supporting the direct chill casting molds limits the number of direct chill casting molds that can be used during a single casting operation. Positioning the direct chill casting molds as close to one another as feasible improves the capacity of the casting pit and system and thereby the overall efficiency of a casting operation.

As described above, a graphite casting surface in the form of a graphite liner may be used as a casting surface for molten aluminum. A lubricant, such as an oil or grease, spread on the surface of the graphite soaks into the porous graphite. During the casting process, the oil or grease is consumed as it migrates from the interior of the graphite liner to the casting surface where it is carried away or burned by the casting. It is important for the graphite to stay cool relative to the casting in order to stay below a working temperature of the lubricant. If the graphite liner becomes too hot, the lubricant may burn and glaze the surface of the graphite, preventing oil from migrating in or out of the graphite.

FIG. 5 shows a cross section of the side wall 210. The mold side wall 210 includes two cooling fluid channels 250 and 255. While the illustrated embodiment described herein depicts two fluid chambers (250 and 255) there may be more or fewer fluid chambers based on the desired design configuration. A single fluid chamber may be used in some embodiments to provide cooling fluid flow through the side wall 210. Optionally, more than two fluid chambers may be used, particularly in an embodiment in which different flow rates or pressures may be desirable through orifices associated with each of the fluid chambers.

During the casting process, as material exits the mold cavity in response to the starter block 157 advancing downwardly as shown in FIG. 2, cooling of the material exiting the mold cavity is necessary to properly form the ingot 160. This cooling is expedited by the use of cooling fluid or coolant sprayed from orifices proximate the bottom of the side wall 210 in the direction of the material exiting the mold cavity. Also shown is a fluid chamber 261 formed into the back side of side wall 210 and separated from the fluid chambers 250 and 255. Fluid chamber 261 of an example embodiment is configured to carry lubricating fluid (e.g., oil or grease) along the length of the side wall 210 and is in communication with the plurality of orifices 262 (of which a cross-section of one is shown in FIG. 5), which provides lubricating fluid to the casting surface 211 of the side wall 210. The lubricating fluid may be provided to the fluid chamber 261 at a relatively high pressure and release into the mold at a more uniform and lower pressure. The lubricating fluid exits the orifice 262 flowing generally downwardly along the casting surface 211 of the side wall 210 rather than spraying outwardly from the side wall to provide a layer of lubrication between the casting and the casting surface 211 of the side wall 210. Each of the plurality of orifices 262 for providing lubricating fluid to the face of the casting surface 211 may be configured to allow lubricating fluid to flow substantially evenly across the length of the side wall 210 using as many or as few lubricating fluid orifices as deemed appropriate for the size of the mold and the material to be cast. Optionally, lubricant can be applied to the casting surface 211 between castings rather than supplied through a fluid chamber 261.

The casting surface 211 is the surface of a graphite liner 300 that is engaged with the mold side wall 210. The graphite liner 300 provides a porous, lubricating casting surface of the side wall facing the cavity of the mold. This porous, lubricating surface (casting surface 211) promotes smooth flow of the casting as it exits the mold cavity. The graphite material of the graphite liner can permit flow of lubricant through the graphite liner 300, such as from fluid chamber 261, or the graphite material can have a lubricant applied to the casting surface 211 before a casting operation where the lubricant absorbs into the graphite liner.

As noted above, embodiments may include any number of cooling fluid chambers, where each cooling fluid chamber may feed one or more sets of orifices for providing cooling fluid to the cast part as it exits the mold. As shown in FIG. 5, cooling fluid chambers 250 and 255 may be configured to carry cooling fluid to two sets of cooling orifices 264 and 266. While both orifices 264 and 266 are visible in the cross-section view of FIG. 5, along with the fluid flow paths for each, it is appreciated that both orifices and associated fluid flow pathways may not be visible in a physical section view. The cross-section view of FIG. 5 is provided for illustration and ease of understanding. While the orifices 264, 266 are illustrated as round, embodiments may include orifices 264, 266 which are elongate along the side wall 210. This may enable a different cooling fluid flow pattern from the orifices for cooling the cast part as it exits the mold.

According to the illustrated embodiment, fluid chamber 255 may be in fluid communication with cooling orifices 264, which may each be arranged at a first angle with respect to the side wall 210, as shown by arrow 265 indicating the direction of fluid exiting the first plurality of cooling orifices 264. The second plurality of cooling orifices 266 may be arranged to direct cooling fluid at a different angle as shown by arrow 267. However, the second plurality of cooling orifices may be in fluid communication with cooling fluid chamber 250 rather than chamber 255. In order to supply cooling fluid from the cooling fluid chamber 250 to the plurality of orifices 266, a channel 270 may be machined or otherwise formed into the back face of the side wall 210. A channel 270 may be present for each of the second set of cooling orifices 266, or alternatively, channels 270 may exist at a plurality of locations along the length of the side wall in cooperation with a channel closer to the second set of cooling orifices 266 extending longitudinally along the side wall 210 in a manifold arrangement.

According to the illustrated embodiment, the cooling fluid flow through each of the first plurality of orifices 264 and the second plurality of orifices 266 may be independently fed by a respective cooling fluid chamber 250, 255. This configuration enables a cooling profile to be generated according to the type of material being cast with the appropriate flow rates and spray patterns from the respective set of cooling orifices.

In addition to providing cooling fluid to the orifices 264, 266, the cooling fluid chambers 250 and 255 provide a cooling effect on the side wall 210 itself and to the graphite liner 300 and casting surface 211 thereof. Cooling fluid chambers 250 and 255 are arranged in a manner that facilitates heat extraction from the back face of the side wall 210 into the cooling fluid. This side wall cooling effect further reduces the temperature of the graphite liner 300 and casting surface 211 of the side wall 210 to avoid overheating the lubricating fluid which can result in premature evaporation or burning of the lubricating fluid. Cooling of the side wall 210 using cooling fluid chambers 250 and 255 further reduces the likelihood and degree to which lubricating fluid would burn or evaporate as it flows down along the casting surface 211 with the cast material. Heat from a casting is drawn through the casting face of the graphite liner 300, through the mold wall, and carried away through cooling fluid in the cooling fluid chambers. Thus, it is important to maximize heat transfer between components to maximize the cooling effect on the graphite liner.

The graphite liner 300 of example embodiments described herein is removably attached to the mold side wall 210. The graphite liner 300 is, in some embodiments, a consumable part that may require replacement. Further, as the mold side wall 210 is generally aluminum, the graphite liner 300 must be attached or secured to the mold side wall 210. According to the illustrated embodiment of FIG. 5, the graphite liner 300 includes an angled bottom edge 305 that is received into a complementary channel 310 of the side wall 210. The bottom edge 305 received within the channel 310 provides support for the graphite liner 300 as the casting exits the mold cavity. A similar configuration is provided on a top surface of the graphite liner 300 where an angled top edge 315 is received within a complementary channel 320 within a removable upper edge 330 of the mold side wall 210. The removable upper edge 330 is secured to the mold side wall 210 with fasteners 335, one of which is depicted in the cross-section of FIG. 5. Replacement of the graphite liner 300 is performed by removing the upper edge 330 of the mold side wall 210, removal of a worn or defective graphite liner 300, and replacement of the graphite liner. The upper edge 330 is then replaced and secured with fasteners 335.

Attachment of the graphite liner 300 to the mold side wall 210 is not a trivial process, particularly in an embodiment in which the mold side wall is flexed during the casting operation. Heat transfer between the graphite liner and the mold side wall to the cooling fluid of the cooling chambers 250 and 255 is critical to maintain temperatures at the casting surface 211 that are below a level which would burn the lubricant.

Graphite is less ductile than aluminum and a relatively thin graphite liner may be used for a greater range of flexibility. However, a thinner graphite liner is more difficult to secure to a mold side wall, particularly using the mechanism described with respect to FIG. 5, since there is less surface and area to clamp. Clamping mechanisms can be varied, such as changing the orientation of fasteners and reducing the size of fasteners. However, the area of the graphite liner available for clamping force application remains low. Embodiments described herein employ a novel mechanism of forming a graphite liner and attaching a graphite liner to a mold side wall.

FIG. 6 illustrates a portion of a mold side wall including a graphite liner 400. The portion of the mold side wall illustrated includes a substrate 440 portion that is coupled to or is part of the assembly of the mold side wall. As shown, the graphite liner 400 includes an angled bottom edge 405. The angle formed may be between around 20-degrees and 60-degrees, or more specifically, around 45-degrees relative to a casting face 411 of the graphite liner. The angled bottom edge 405 may form a chamfer between a back surface 412 of the graphite liner and the casting face 411 as shown in FIG. 6. A groove 410 having a complementary angle is formed in the substrate 440 to receive the angled bottom edge 405 of the graphite liner 400. The graphite liner 400 of the illustrated embodiment further includes an angled top edge 415, the angle of which may also be between around 20-degrees and 60-degrees, and more specifically around 45-degrees relative to the casting face 411. The angled top edge 415 may form a chamfer between a back surface 412 of the graphite liner and the casting face 411 as shown in FIG. 6.

A clamping element 420 including a complementary angled element to engage the angled top edge 415 of the graphite liner 400 is secured to the substrate with fastener 425. The fastener may include, for example, a threaded fastener received within a threaded hole of the mold wall substrate 440. The threaded fastener 425 may be secured with a locking feature to reduce the likelihood of the fastener inadvertently loosening. The locking feature may include, for example, thread locking compound or the like. Optionally, the threaded fastener can be engaged with a locking washer, such as a split-lock washer, spring washers (e.g., Belleville washers), or wedge washers, for example. Locking washers can help avoid loosening of the clamping element which can result in reduced contact between the graphite liner 400 and the mold wall substrate 440, thereby reducing heat transfer efficiency.

The clamping element 420 further includes an upper angled face 430 that engages with a complementary substrate angled face 435. As the fastener 425 is tightened driving the clamping element 420 toward the substrate 440, the substrate angled face 435 presses against the upper angled face 430 of the clamping element which drives the clamping element down, toward the graphite liner 400. A slot 427 formed in the clamping element 420 enables some degree of vertical movement of the clamping element relative to the substrate 440. The fastener 425 may include a shoulder fastener where the shoulder rides in the groove 427 as the clamping element 420 is tightened to avoid binding. As the clamping element is driven toward the graphite liner 400, the angled top edge 415 of the graphite liner is engaged and driven downward, driving the angled bottom edge 405 into the groove 410 of the substrate 440 having the complementary angle. This system secures the graphite liner 400 to the substrate 440 and facilitates a thermal interface between the graphite liner 400 and the substrate 440 for transfer of heat from the graphite liner to the substrate of the mold side wall.

The clamping mechanism of the embodiment of FIG. 6 enables the graphite liner 400 to flex with a mold side wall when it flexes as described above. The groove 410 proximate the bottom of the mold wall substrate 440 grasps the graphite liner along its length, and the clamping element 420 can extend longitudinally along the mold wall substrate proximate a top of the mold wall substrate. Optionally, the clamping element may be one of a plurality of clamping elements disposed along a length of the mold side wall substrate, with the clamping elements being sufficiently close to one another to ensure the top edge of the graphite liner is maintained in contact with the mold side wall substrate during the casting operation and as the mold side wall flexes.

According to another example embodiment described herein, the graphite liner can be shrink fit to the mold wall substrate. According to such an example embodiment, the clamping element 420 can be fixed to the mold wall substrate 440 or part of the mold wall substrate. The mold wall can be heated to expand a distance between the clamping element 440 and the groove 410, whereupon the graphite liner 400 can be slid into engagement with the mold wall substrate, with the top edge 415 and bottom edge 405 received within the groove formed by the clamping element 420 and the groove 410 along the bottom of the mold wall substrate 440. In response to the mold wall substrate cooling, the distance between the clamping element 420 and the groove 410 becomes smaller (due to thermal expansion and contraction), and the graphite liner 400 can become securely grasped and engaged with the mold wall substrate.

While the example embodiment of FIG. 6 can provide a thermal interface between the graphite liner 400 and the substrate 440, the graphite liner may not provide complete contact along a back face of the graphite liner to the substrate. Greater contact between the graphite liner and the substrate results in greater heat transfer efficiency and thereby reduces the temperature at the casting face of the graphite liner and reduces the likelihood of lubricant burning or evaporation. Embodiments provided herein further include a graphite liner with a curvature machined into a back face of the graphite liner to promote improved contact between the back face of the graphite liner and the substrate. FIG. 7 illustrates a graphite liner 500 with a casting face 511 and a back face 512 that is formed with a curvature. The casting face 511 includes a concave curvature as shown when the graphite liner is not installed onto a mold wall while a back face 512 or back surface defines a convex curvature. Graphite liner 500 is illustrated in a "resting state" or uninstalled state, where the profile shown in FIG. 7 of graphite liner 500 is as the graphite liner is produced or manufactured.

The curvature formed in the back face 512 of the graphite liner 500 of FIG. 7 is specifically configured to press the back face of the graphite liner into engagement with the substrate when installed to the substrate of the mold wall when in an "installed state". For example, the curvature may be optimized to provide maximum pressure according to the stiffness of the shape in the lower third of the graphite liner. The curvature of the back face of the graphite liner in the resting state can be of a single radius, a compound curvature, or a spline, for example. The curvature may include a location of a peak bend or smallest radius that can aid in focusing a force applied by the graphite liner when driven into the installed state. The curvature of the back face of the graphite liner may optionally be inconsistent along the length of the graphite liner along the mold wall substrate. For example, the back face of the graphite liner may have a first curvature profile proximate a center of a mold wall and a different curvature profile proximate the ends of the mold wall. According to some embodiments, the mold wall substrate may include a curvature, such as a convex curvature to interface with a back face of the graphite liner. In such an embodiment, the graphite liner is configured such that in the installed position, the back face of the graphite liner is driven into contact with the curvature of the mold wall substrate while the casting face of the graphite liner attains a substantially flat casting surface.

When casting, the lower third of the graphite liner is the location of the mold wall where steady state casting is occurring and therefore the location that the graphite tends to be at a higher temperature. Referring to the graphite liner 500 of FIG. 7, installation of the graphite liner to the substrate 440 as shown in FIG. 6 results in the graphite liner reaching an "installed state" attaining a shape of the installed graphite liner shown in FIG. 6; however, due to the curvature of the back face 512, the graphite liner exerts a force of pressing against the substrate, particularly in a lower third of the graphite liner as the angled bottom edge 505 of the graphite liner engages the complementary angled bottom edge 405, and the clamping element 420 clamps the angled top edge 515 of the graphite liner into the mold wall.

FIG. 7 further illustrates a graphite liner 600 produced with a curvature as with the graphite liner 500 in the installed orientation, where a first clamping force 607 is applied at the angled bottom edge 605 and a second clamping force 617 is applied at the angled top edge 615 by the elements described with respect to FIG. 6. In the installed orientation, the clamping of the graphite liner 600 results in forces exerted by the back face 612 of the liner against the mold wall substrate. The forces exerted are dependent upon the curvature of the manufactured or machined graphite liner and where the peak radius or sharpest bend occurs. The force arrows 620 of FIG. 7 illustrate the force magnitudes with the magnitudes being greatest in the lower third of the back face 612 of the graphite liner 600. As noted above, this region is where the greatest heat transfer needs to occur from the highest temperature portion of the graphite liner to the substrate. The greater forces in this lower third region ensures maximum contact between the back face of the graphite liner and the substrate to promote improved heat transfer.

Embodiments described herein promote heat transfer from a graphite liner (or other liner material) from the casting face of the liner through the mold wall substrate to which the graphite liner is attached. Through application of force between the graphite liner and the mold wall substrate as detailed above, improved contact is maintained between the graphite liner and the mold wall substrate, thereby improving the thermal transfer between the liner and the mold wall. FIG. 8 illustrates example measurements normalized to illustrate the effect of thermal contact resistance relative to contact pressure. As shown, when contact pressure is increased along the x-axis, the thermal contact resistance decreases along the y-axis, thereby improving heat transfer across the interface. As illustrated, a greased interface improves heat transfer characteristics across the interface between the graphite liner and the mold wall substrate. While a greased interface is illustrated in the figure, alternative fluids can also promote heat transfer across the interface, such as a heat-conductive liquid, adhesive, or gel that can be used between the liner and the mold wall substrate. However, both a dry interface and a greased interface realize improvements to heat transfer with an increase in contact pressure between the graphite liner and the mold wall substrate. Thus, the force applied by example embodiments described herein between the graphite liner and the mold wall substrate improves the thermal transfer properties in transferring heat away from the casting surface of the graphite liner to the mold wall substrate.

The illustrated embodiments of FIGS. 3-7 generally employ a graphite liner having a cross-section that tapers from a first thickness proximate a top edge of the graphite liner, to a second thickness proximate a bottom edge of the graphite liner, where the first thickness is greater than the second thickness. This provides a taper from a top of the mold to a bottom of the mold. However, various other cross-section shapes can be employed. FIG. 9 illustrates an example embodiment in which a taper of various angles is employed with the graphite liner. The embodiment 710 of the graphite liner cross-section has no taper. Such an embodiment can, in some cases, be reversible where the graphite liner can be inserted in an inverted manner, turning the top of the graphite liner into the bottom of the graphite liner. This can be done as the casting material generally only wears on a bottom half of the graphite liner, such that life of the graphite liner can be increased substantially with a graphite liner profile that is reversible (inverted top-to-bottom).

The embodiment 720 of the graphite liner cross-section has a slight taper of about one-degree, with a top portion of the graphite liner being thicker than a bottom portion. The subsequent embodiments 730-760 include greater degrees of taper, with embodiment 730 having a two-degree taper, embodiment 740 having a three-degree taper, embodiment 750 having a four-degree taper, and embodiment 760 having a five-degree taper. The taper can facilitate casting formation and a taper can be selected based on a material to be cast and based on a size of the casting.

FIG. 10 illustrates additional embodiments of graphite liner cross-sections; however, the embodiments shown in FIG. 10 include a curvature along a back surface of the graphite liner. This curvature, as described above, is employed to provide improved contact between a mold sidewall and the graphite liner. The improved contact provides improved thermal transfer between the graphite liner and the mold sidewall. As the graphite liner having profiles as shown in FIG. 10 is installed to the mold sidewall, the clamping presses the graphite liner into contact with the mold sidewall, and the back surface straightens against the mold sidewall. This back wall curvature can be designed upwards or downwards from center to improve heat transfer in localized areas as needed by the casting process.

Embodiment 810 of FIG. 10 includes a graphite liner cross-section that has no taper. The dash-dot-dash lines of FIG. 10 reflect an installed-state, such that the dash-dot-dash lines of embodiment 810 are straight and parallel. Embodiment 820 includes a taper of one-degree, while embodiment 830 includes a taper of two-degrees, embodiment 840 includes a taper of three-degrees, embodiment 850 includes a taper of four-degrees, and embodiment 860 includes a taper of five-degrees. The graphite liners illustrated in FIG. 10 each include a clamping surface at a top of the graphite liner cross-section, where the clamping surface is consistent across the different embodiments. In the illustrated embodiments, that clamping surface is arranged at a 45-degree angle. This configuration facilitates the driving of the graphite liner into contact with the mold side wall as the graphite liner is clamped into position. Further, the bottom edge of the graphite liner is driven further into engagement with a corresponding channel in the mold side wall to securely hold the graphite liner to the mold side wall.

While embodiments can employ a taper along the entire vertical face of the graphite liner, embodiments can optionally employ asymmetrical and irregular tapers. FIG. 11 illustrates an embodiment 910 of a graphite liner that includes a vertical top portion 912 and a tapering lower portion 914. FIG. 11 further illustrates an embodiment 920 having an upper tapering portion 922 and a lower vertical portion 924.

According to some embodiments, based on a height of molten metal within a continuous casting mold, only a portion of the graphite liner may contact the molten metal. According to such an embodiment, only a portion of the graphite liner in contact with the molten metal may experience wear. FIG. 12 illustrates example embodiments of graphite liner configurations that capitalize on such casting scenarios. The embodiment 930 of FIG. 12 has a profile that is symmetrical about a centerline 932. This configuration enables the graphite liner to be reversible, where the graphite liner can be inverted. A graphite liner such as that of embodiment 930 can thus have substantially double the life of a non-reversible graphite liner, as only a portion below the centerline 932 experiences wear during a casting operation. Embodiment 940 is a similar configuration, symmetrical about centerline 932 and therefore reversible. The embodiment 930 and embodiment 940 include a curvature having a thickness in the middle, at centerline 932, greater than a thickness at the top and bottom of the graphite liner.

FIG. 13 illustrates further embodiments of reversible graphite liners. While the embodiments of FIG. 12 employ a curved surface of the graphite liner, embodiment 950 includes a linear taper from a centerline 952 to a bottom of the liner. The profile of embodiment 950 is symmetrical about the centerline 952, such that the thickness of the liner tapers from the center to the top. Embodiment 960 is a larger version of embodiment 950, with a linear taper from centerline 952 to both the top and the bottom. In embodiments 950 and 960, the graphite liner is thickest at the centerline 952.

While the graphite liner of the embodiments shown in FIGS. 9-13 do not include a curvature along a back face of the graphite liners, these embodiments can employ the curved back face as shown and described with respect to the embodiment of FIG. 7.

Embodiments described above can be employed on any mold wall whether the mold wall is a side wall or an end wall. Further, embodiments are configured to function with mold walls that are flexible and are flexed to impart a radius to a mold wall. In some embodiments, a conductive material such as a liquid, an adhesive, or gel can be used between the graphite liner and the substrate as noted above. In an example embodiment, a grease may be used between the mold wall substrate and the graphite liner. The grease of an example embodiment can improve contact between the mold wall substrate and the graphite liner. Other materials, such as the aforementioned liquid or gel, or a deformable gasket made of thermally conductive material can be used at the interface between the liner and the mold wall substrate to increase the surface contact of the surfaces at the interface with the interstitial material thereby increasing the area for heat transfer.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A graphite liner for a continuous casting mold comprising:

a bottom edge defining a first angled surface and a top edge defining a second angled surface, wherein the bottom edge is received into a groove of the continuous casting mold; and wherein the graphite liner is configured to be reversible, where the bottom edge becomes the top edge, and wherein a mold wall and a clamping element cooperate to clamp the graphite liner to the mold wall of the continuous casting mold, wherein the graphite liner defines a resting state and an installed state, wherein the graphite liner in the resting state comprises a curvature along a back face of the graphite liner between the top edge and the bottom edge, and wherein the back face is straightened in the installed state in response to the graphite liner being clamped to the mold wall of the continuous casting mold.

2. The graphite liner of claim 1, wherein the graphite liner has a first thickness proximate a center of a vertical height of the graphite liner, a second thickness proximate the top edge of the graphite liner, and a third thickness proximate the bottom edge of the graphite liner, wherein the first thickness is greater than the second thickness and the third thickness.

3. The graphite liner of claim 2, wherein the second thickness is substantially equal to the third thickness.

4. The graphite liner of claim 1, wherein the curvature along the back face of the graphite liner is convex.

5. The graphite liner of claim 4, wherein the curvature of the back face of the graphite liner comprises a curvature profile, wherein in the installed state, a force is applied by the graphite liner to the mold wall of the continuous casting mold in response to a fastener pressing a clamping element toward the mold wall.

6. The graphite liner of claim 5, wherein the curvature profile is configured to concentrate the force applied by the graphite liner to the mold wall in the installed state at a lower third of a height of the graphite liner.

7. A continuous casting mold component comprising:

a mold wall substrate defining a groove proximate a bottom of the mold wall substrate;

a graphite liner having a bottom edge defining a first angled surface and a top edge defining a second angled surface, wherein the bottom edge is received into the groove of the mold wall substrate; and a clamping element defining an angled clamping surface attached to the mold wall substrate with at least one fastener, wherein the graphite liner is configured to be reversible, where the bottom edge becomes the top edge, and wherein the mold wall and the clamping element cooperate to clamp the graphite liner to the mold wall, and wherein the graphite liner defines a resting state and an installed state, where the graphite liner is in the installed state when the clamping element and the mold wall cooperate to clamp the graphite liner to the mold wall, and wherein a back surface of the graphite liner defines a curve between the top edge and the bottom edge in the resting state, and wherein the graphite liner is straightened between the top edge and the bottom edge in the installed state.

8. The continuous casting mold component of claim 7, wherein the graphite liner has a first thickness proximate a center of a vertical height of the graphite liner, a second thickness proximate a top of the graphite liner, and a third thickness proximate a bottom of the graphite liner, wherein the first thickness is greater than the second thickness and the third thickness.

9. The continuous casting mold component of claim 8, wherein the second thickness and the third thickness are substantially equal.

10. The continuous casting mold component of claim 8, the mold wall substrate further defining a substrate angled surface proximate a top of the mold wall substrate, wherein the clamping element defines an angled driving surface, wherein in response to the fastener pressing the clamping element toward the mold wall substrate, the substrate angled surface cooperates with the angled driving surface to drive the clamping element toward the bottom of the mold wall substrate.

11. The continuous casting mold component of claim 10, wherein the fastener comprises a threaded fastener, wherein the clamping element defines a slot to receive the threaded fastener, and wherein the threaded fastener is received into a threaded hole of the mold wall substrate.

12. The continuous casting mold component of claim 11, wherein the slot defined in the clamping element has a relatively narrow dimension in a direction of an axis along which the mold wall substrate extends, and a relatively long dimension extending in a direction toward the bottom of the mold wall substrate.

13. The continuous casting mold component of claim 12, wherein the clamping element is driven in a direction toward the bottom of the mold wall substrate in response to the threaded fastener being tightened into the threaded hole of the mold wall substrate.

14. The continuous casting mold component of claim 8, wherein the graphite liner comprises a first thickness proximate the top edge of the graphite liner and a second thickness proximate the bottom edge, wherein the first thickness is greater than the second thickness.

15. The continuous casting mold component of claim 14, wherein the graphite liner tapers from the first thickness to the second thickness.

16. The continuous casting mold component of claim 7, wherein the first angled surface of the graphite liner is driven into the groove defined in the substrate in response to the angled clamping surface of the clamping element engaging the second angled surface of the graphite liner and the fastener pressing the clamping element toward the mold wall substrate.

17. The continuous casting mold component of claim 7, wherein the graphite liner in the resting state comprises a convex curvature along a back face of the graphite liner between the top edge and the bottom edge.

18. The continuous casting mold component of claim 17, wherein the back face is straightened in the installed state in response to the fastener pressing the clamping element toward the mold wall substrate.

19. The continuous casting mold component of claim 18, wherein the curvature of the back face of the graphite liner comprises a curvature profile, wherein in the installed state, a force is applied by the graphite liner to the mold wall substrate in response to the fastener pressing the clamping element toward the mold wall.

20. The continuous casting mold component of claim 19, wherein the curvature profile is configured to concentrate the force applied by the graphite liner to the mold wall substrate in the installed state at a lower third of the graphite liner.

* * * * *